US005935394A

United States Patent [19]

Sivilotti et al.

[11] Patent Number: 5,935,394

[45] Date of Patent: Aug. 10, 1999

[54] MULTI-POLAR CELL FOR THE RECOVERY OF A METAL BY ELECTROLYSIS OF A MOLTEN ELECTROLYTE

[75] Inventors: Olivo Giuseppe Sivilotti; Meine Vandermeulen, both of Kingston, Canada; Junkichi Iseki, Osaka, Japan

[73] Assignee: Alcan International Limited, Montreal, Canada

[21] Appl. No.: 08/945,303

[22] PCT Filed: Apr. 21, 1995

[86] PCT No.: PCT/CA95/00227

§ 371 Date: Jan. 13, 1998

§ 102(e) Date: Jan. 13, 1998

[87] PCT Pub. No.: WO96/33297

PCT Pub. Date: Oct. 24, 1996

[51] Int. Cl.[6] ..... C25C 3/00; C25C 3/04

[52] U.S. Cl. ..... 204/244; 204/280; 204/294

[58] Field of Search ..... 204/244, 245, 204/294, 280

[56] References Cited

U.S. PATENT DOCUMENTS

| | | | |
|---|---|---|---|
| 1,921,377 | 8/1933 | Ward . | |
| 2,393,685 | 1/1946 | Hunt . | |
| 2,629,688 | 2/1953 | Hunter . | |
| 3,676,323 | 7/1972 | Strelets et al. | 204/244 |
| 3,749,660 | 7/1973 | Vladimirovich et al. | 204/244 X |
| 3,968,022 | 7/1976 | Eng et al. . | |
| 4,058,448 | 11/1977 | Muzhzhavlev et al. . | |
| 4,334,975 | 6/1982 | Ishizuka . | |
| 4,401,543 | 8/1983 | Ishizuka . | |
| 4,481,085 | 11/1984 | Ishizuka . | |
| 4,514,269 | 4/1985 | Sivilotti . | |
| 4,604,177 | 8/1986 | Sivilotti . | |
| 4,740,279 | 4/1988 | Müller et al. . | |
| 4,816,511 | 3/1989 | Castonguay et al. . | |
| 4,944,859 | 7/1990 | Matsunami et al. . | |
| 4,960,501 | 10/1990 | Sivilotti . | |
| 5,650,053 | 7/1997 | Gay et al. | 204/244 X |

FOREIGN PATENT DOCUMENTS

| | | |
|---|---|---|
| 0101243 | 2/1984 | European Pat. Off. . |
| 0101244 | 2/1984 | European Pat. Off. . |
| 0264263 | 4/1988 | European Pat. Off. . |
| 0291498 | 7/1989 | European Pat. Off. . |
| 0324563 | 7/1989 | European Pat. Off. . |
| 2243277 | 4/1975 | France . |
| 1483208 | 8/1977 | United Kingdom . |
| 2053275 | 6/1980 | United Kingdom . |

OTHER PUBLICATIONS

EPO Search Report.

*Primary Examiner*—Donald R. Valentine
*Attorney, Agent, or Firm*—Cooper & Dunham LLP

[57] ABSTRACT

An electrolytic cell for the recovery of metal from a molten electrolyte and an electrode assembly for use in such a cell. The cell (10) comprises an electrode assembly consisting of an anode (17), a cathode (19) and one or more bipolar electrodes (18) disposed between the anode and the cathode so as to form interpolar spaces (16) in which electrolysis occurs. In the electrode assembly, the bipolar electrode (if there is only one) or the innermost bipolar electrode (if there are more than one) substantially surrounds the anode and forms a single mechanical and electrical entity. The cathode in turn preferably substantially surrounds the one or more bipolar electrodes. The electrode assembly comprising the cathode and bipolar electrode(s) is preferably unitary, forming an electrode cassette that can be assembled outside a cell and then introduced into, or withdrawn from, the cell as a single self-supporting unit. Structures of this kind simplify cell fabrication and may lead to cells that operate with improved efficiency.

25 Claims, 8 Drawing Sheets

MULTI-POLAR CELL FOR THE RECOVERY OF A METAL BY ELECTROLYSIS OF A MOLTEN ELECTROLYTE

This application is a 371 of PCT/CA95/00227, filed Apr. 21, 1995.

TECHNICAL FIELD

This invention relates to improved electrolytic cells for the production of metals from molten electrolytes. More particularly, the invention relates to multi-polar electrolytic cells used for this purpose.

BACKGROUND ART

U.S. Pat. Nos. 4,604,177 and 4,514,269 describe electrolytic cells used for producing metals, such as magnesium, by electrolysis, which cells each have a housing in which one or more electrode assemblies are disposed. Each electrode assembly includes a cathode assembly, defining a vertical cavity in which an anode and one or more bipolar electrode assemblies are disposed between the anode and the cathode assembly. Baffles are provided for preventing or impeding the flow of electrolyte between adjacent cathode assemblies and/or between each cathode assembly and an adjacent wall of the housing. However, the geometry and design of such electrolytic cells makes them difficult to fabricate with uniform inter-electrode spacings and such designs are also expensive to produce and operate. Furthermore, leakage currents between electrodes cause reductions of current efficiency. Thus, there is a need to provide improved electrolytic cells in order to simplify the method of cell construction and repair while also achieving higher current efficiencies, lower power consumption per kilogram of metal produced, and more compact and less expensive cell designs.

DISCLOSURE OF THE INVENTION

An object of the present invention is therefore to provide electrolytic cells of improved internal design.

Another object of the invention is to provide electrolytic cells that can be assembled, and preferably disassembled, simply and reliably.

Yet another object of the invention is to provide electrolytic cells that can be operated economically and efficiently.

According to one aspect of the invention, there is provided an electrolytic cell for recovery of a metal from a molten electrolyte containing a metal compound, said cell having a housing containing at least one internal electrolysis compartment, at least one electrode assembly in each said compartment, said assembly including an anode, a cathode and at least one bipolar electrode disposed between said anode and said cathode so as to form interpolar spaces in which electrolysis occurs, and connections for conveying electrical current to and from said cell, characterized in that said bipolar electrode, or each said bipolar electrode when there is more than one, mechanically and electrically comprises a single entity and substantially completely surrounds the principal electrolysing surfaces of said anode, or a next innermost bipolar electrode, and in that said cathode substantially completely surrounds the principal electrolysing surfaces of said bipolar electrode or, when there is more than one of said bipolar electrodes, an outermost one of said bipolar electrodes.

According to yet another aspect of the invention, there is provided an electrolytic cell for recovery of a metal from a molten electrolyte containing a metal compound, said cell having a housing containing at least one internal electrolysis compartment, at least one electrode assembly in each said compartment, said assembly comprising an anode, a cathode and at least one bipolar electrode disposed between said anode and said cathode so as to form interpolar spaces in which electrolysis occurs, and connections for conveying electrical current to and from said cell, characterized in that said cathode substantially completely surrounds said at least one bipolar electrode and said anode and in that said cathode and said at least one bipolar electrode are held together in the form of a unitary assembly that can be inserted into the electrolysis compartment as a unit during cell assembly.

According to yet another aspect of the invention, there is provided an electrode assembly for insertion into an electrolytic cell used for recovery of a metal from a molten electrolyte containing a metal compound, including at least one bipolar electrode and a cathode, characterized in that each said bipolar electrode comprises mechanically and electrically a single entity, and in that said cathode substantially completely surrounds said bipolar electrode(s) and holds said bipolar electrode(s), forming a unitary assembly.

According to yet another aspect of the invention, there is provided an electrolytic cell for recovery of a metal from a molten electrolyte containing a metal compound, said cell having a housing containing at least one internal electrolysis compartment, at least one electrode assembly in each said compartment, said assembly comprising an anode and a cathode, and connections for conveying electrical current to and from said cell, characterized in that said cathode has a structure that incorporates an electrolyte level control mechanism.

In the cells according to the present invention, the anode is preferably cylindrical in horizontal cross-section and the bipolar electrodes and cathode are preferably annular in horizontal cross-section, but cross-sectional shapes other than cylindrical and annular may be employed for the electrodes, in desired, e.g. oval, elliptical, square, rectangular, polygonal, etc. Cylindrical and annular shapes are preferred because the electrodes can then be manufactured more simply, economically and accurately, as will be more apparent later. In any event, the central anode is substantially completely concentrically surrounded about its principal electrolysing (generally vertical or substantially vertical) surfaces by the bipolar electrode(s) and finally by the external cathode of generally corresponding geometry. The principal electrolysing surfaces of the anode, cathode and bipolar electrodes are the surfaces at which the majority of the electrolysis is intended to take place. Thus, most of the electrolysis is intended to take place at the submerged confronting vertical (or approximately vertical) surfaces of the electrodes, but some small secondary electrolysis may take place at the lower surfaces or at the lower edges or corners of the electrodes. In the present invention, it is not necessary, although in some cases it may be preferred, to ensure that the bipolar electrodes and the cathode "surround" (i.e. confront) these secondary or subordinate electrolysing surfaces of the next innermost electrodes.

The interpolar separation between any two adjacent electrodes should be essentially the same at all points within the cell and should be appropriate for efficient electrolysis (normally within the range of 3 to 30 mm, and more preferably 5 to 15 mm).

The bipolar electrode, or each bipolar electrode when there are several, preferably comprises a unitary body (i.e. a single entity considered from the electrical and mechanical points of view) concentrically surrounding the anode or concentrically surrounding a next-innermost bipolar electrode. The surfaces of the electrodes, and the anode surface itself, are preferably vertical, but may alternatively be tapered inwardly towards the bottom of the cell. While the electrodes comprise unitary bodies, they may have breaks, gaps, holes, slots or other interruptions in their surfaces, provided the electrical and mechanical behaviour of the electrode is substantially unaffected in service by such interruptions. Nevertheless, it is most preferably, for the greatest mechanical strength and electrical performance, that the electrodes have no interruptions of this nature and that the vertical sections (i.e. the parts having opposed anode-facing surfaces and cathode-facing surfaces) of the bipolar electrodes form continuous uninterrupted surfaces formed around the anode or the next-innermost bipolar electrode.

Most preferably, the cathode and the bipolar electrode(s) are held together in the form of a self-supporting unitary assembly or "cassette" that can be assembled outside the cell and then placed in the cell interior as the cell is being assembled ready for service. The cell is then completely by the insertion of an anode into a central vertical interior axial space provided within the cassette. Such a cassette arrangement must hold the one or more bipolar electrodes within the cathode and its extensions securely enough to permit transfer to and assembly within the cell and hold the electrodes reliably at the required interpolar spacing from each other. In order to do this, insulating spacers, e.g. shims, blocks, strips or similar devices, are preferably provided between the cathode and the outermost bipolar electrode and between each bipolar electrode (if there is more than one). These spacers are preferably made of insulating refractory materials, and are fixed to the surfaces of the electrodes, preferably by mechanical means (although other means such as gluing may be chosen). Most preferably they are fixed to the other (anodic) surfaces of the bipolar electrode(s). If necessary, similar insulating spacers may be provided between the innermost bipolar electrode and the anode, e.g by providing such spacers on the other surface of the anode before the anode is inserted into the cassette.

In one embodiment of the invention, the cassette arrangement is further secured by providing the cathode and interpolar electrode(s) with inwardly directed extensions at their lower ends. These extensions are preferably substantially horizontal. Each such extension can act as a support for the next innermost electrode, with the ultimate support coming from the cathode, which is normally a strong metallic shell forming the exterior of the cassette. Of course, the various electrodes must not make electrical contact at their lowermost extensions (or anywhere else), so the necessary mutual support can be provided via non-conducting spacers in the form of blocks or shims. Such spacers are generally fabricated from insulating refractory materials, and are preferably fixed to the surfaces of the electrode extensions.

Alternatively, instead of providing each electrode of the cassette assembly with inwardly directed extensions, the necessary support may instead be provided by an insulating structure, e.g. a flat plate or a plurality of members provided with openings or spacings for electrolyte flow, made of an electrically non-conducting but suitably strong material fixed to the cathode and extending across its lowermost opening. The single or multiple bipolar electrodes can then sit with their lowermost ends on the supporting plate or members and may have blocks or shims of non-conductive material positioned between the vertical surfaces of the various component electrodes to maintain suitable interpolar spacing. The above plate or members may be fixed to the cathode by providing supports for the cathode, such as a continuous horizontally inwardly projecting lip on the cathode, or a series of inwardly projecting tabs, or narrow cross-members extending from one point on the lower end of the cathode to a point diametrically opposite, on which the plate rests. The latter type of support is employed in particular when a series of refractory members are used.

Incidentally, it should be pointed out that when the cell is in service, the various bipolar electrodes experience a buoyancy force due to their immersion in the quite dense electrolyte and may thus no longer need much support against downward movement. Nevertheless, when providing a removable cassette, support of the various electrodes against the force of gravity clearly has to be provided.

The cassette designs using electrode extensions, plates or members fixed to the cathode are strong and rigid enough to require no additional support from beneath when they are transferred to the cell and they may be supported solely from an attachment to a busbar or other secure element of the cell.

Whatever the design of the cassette and its mode of support in the cell, the resulting structure must always permit electrolyte to flow between the various component electrodes during service, and should preferably create as uniform an electrolyte flow as practical. Furthermore, since the cassette design with continuous electrode surfaces essentially eliminates leakage currents on the sides of the electrodes, the remaining leakage currents (that is, currents which pass between non-nearest-neighbour electrodes) are primarily at the bottom of the cassette, and the design of the cassette is also arranged to minimize these leakage currents as well.

The bipolar electrodes used in the present invention are preferably made of graphite. However, one or more of the bipolar electrodes may be provided with a surface lining of steel or other suitable metal on the cathodic face (the surface facing the anode). The steel surface lining may be fixed to the graphite mechanically or by using a glue or cement. The steel lining is wetted by magnesium and this has the effect of reducing the polarization voltage, thereby increasing energy efficiency. The metal lining also enhances the metal release from the surfaces which improves current efficiency.

Apart from the steel linings (if used), the bipolar electrodes are preferably machined as single pieces from blocks of graphite, but may also be formed by gluing or fastening suitably shaped pieces or graphite together, provided the electrodes each then form a single structural (mechanical) and electrical unit. Gluing may be accomplished using an adhesive such as that disclosed in U.S. Pat. No. 4,816,511 (Castonguay et al), the disclosure of which is incorporated herein by reference. Fastening the pieces can be accomplished using screws, or rods, pegs or dowels machined from graphite. The edges to be joined may be machined to form lap joints, dovetail joints, threaded joints or other type of joints to impart strength and contribute to forming a single mechanical and electrical unit.

When the cathode and bipolar electrodes are in the form of a cassette, it is convenient and preferred that the cassette be supported within the cell solely by means of a detachable connection to a busbar within the cell since the cathode anyway must be connected electrically to the busbar and because the busbar is usually capable of supporting considerably loads as a result of its physical strength and secure support on the cell walls or other supporting framework. For this purpose, the cathode may be provided with a hook-like connector element that mounts on an adjacent portion of the cathode busbar, and supports the cassette on the busbar, and ensures that the cathode is held in electrical contact with the busbar. Such an arrangement easily accommodates different rates of expansion and contraction of the cathode and busbar due to heating, when the cell is in service, without resort to the use of expansion joints or the like in the cathode or elsewhere and without causing interruptions in current flow. The mounting arrangement also enables the electrode cassette to be removed from the cell as a unit for service or repair.

From the above description, it will be seen that the present invention, at least in the preferred embodiments using substantially continuous bipolar electrodes and cathodes creates a robust cassette structure, makes it possible to assemble an electrode assembly externally of the cell and to insert it as a unit into the cell. This not only ensures structural stability but also minimizes leakage of currents and improves cell efficiency.

The unitary electrical construction and the preferred use of horizontal cathode and bipolar electrode extensions, or the use of a lower insulating plate or similar support, reduces substantially the bypass currents between electrodes at the bottom and sides of the electrode assembly. The remaining source of bypass currents is then the top surface of the electrodes. By maintaining only a thin layer of electrolyte above the electrodes, the electrical resistance for leakage current is increased. Maintenance of such a thin layer may be accomplished through electrolyte level control within the electrolysis compartment, a preferred arrangement being incorporated into the cathode design. Use of level control minimizes the bypass currents at the top of the electrode assembly, and thus the overall cell and electrode assembly provides improved electrical performance.

BEST MODES FOR CARRYING OUT THE INVENTION

Figure 1:
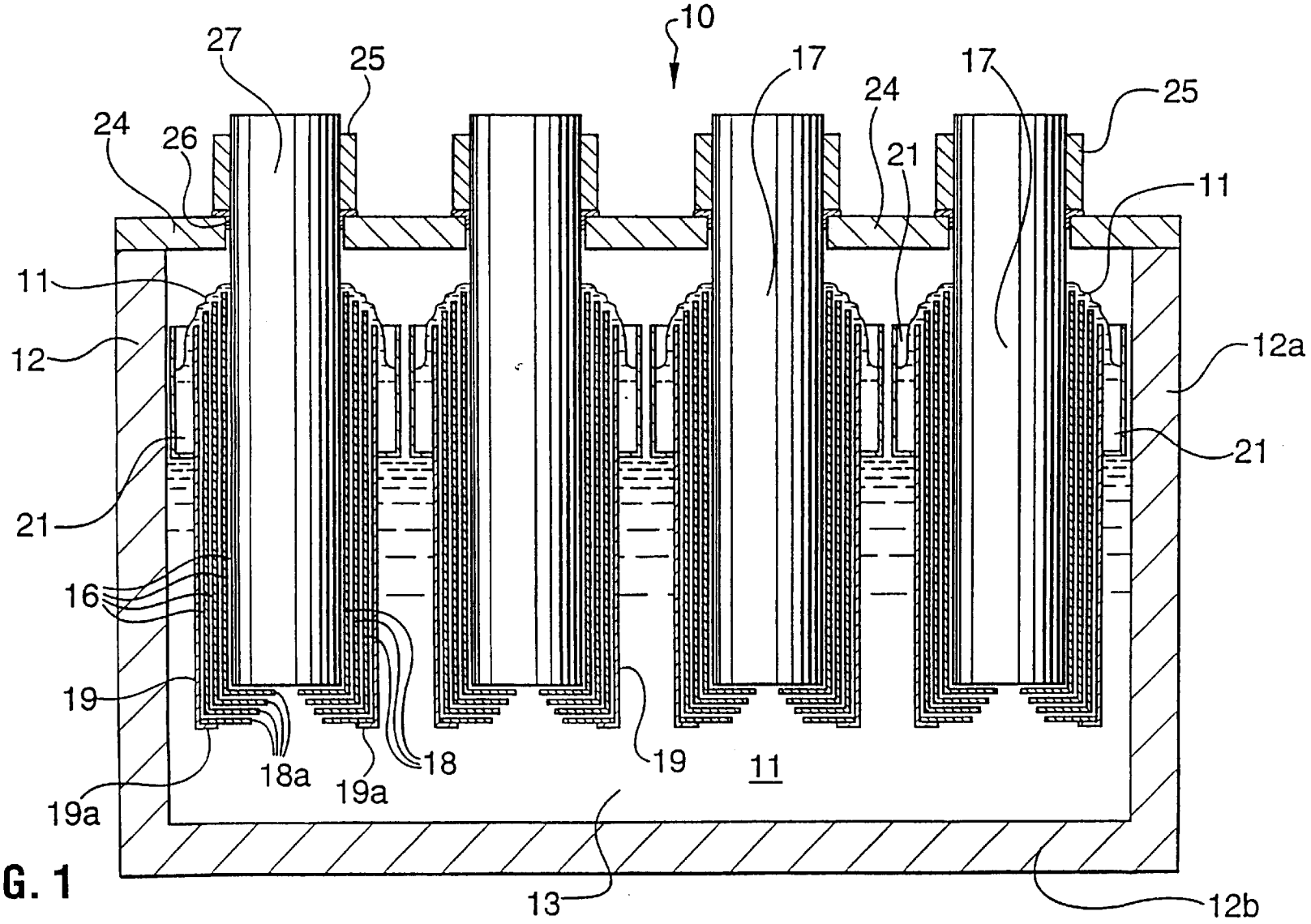
FIG. 1 is a longitudinal vertical cross-section through part of an electrolysis compartment of a cell according to a first preferred embodiment of the present invention showing an annular electrode assemblies and their structures.
Figure 2:
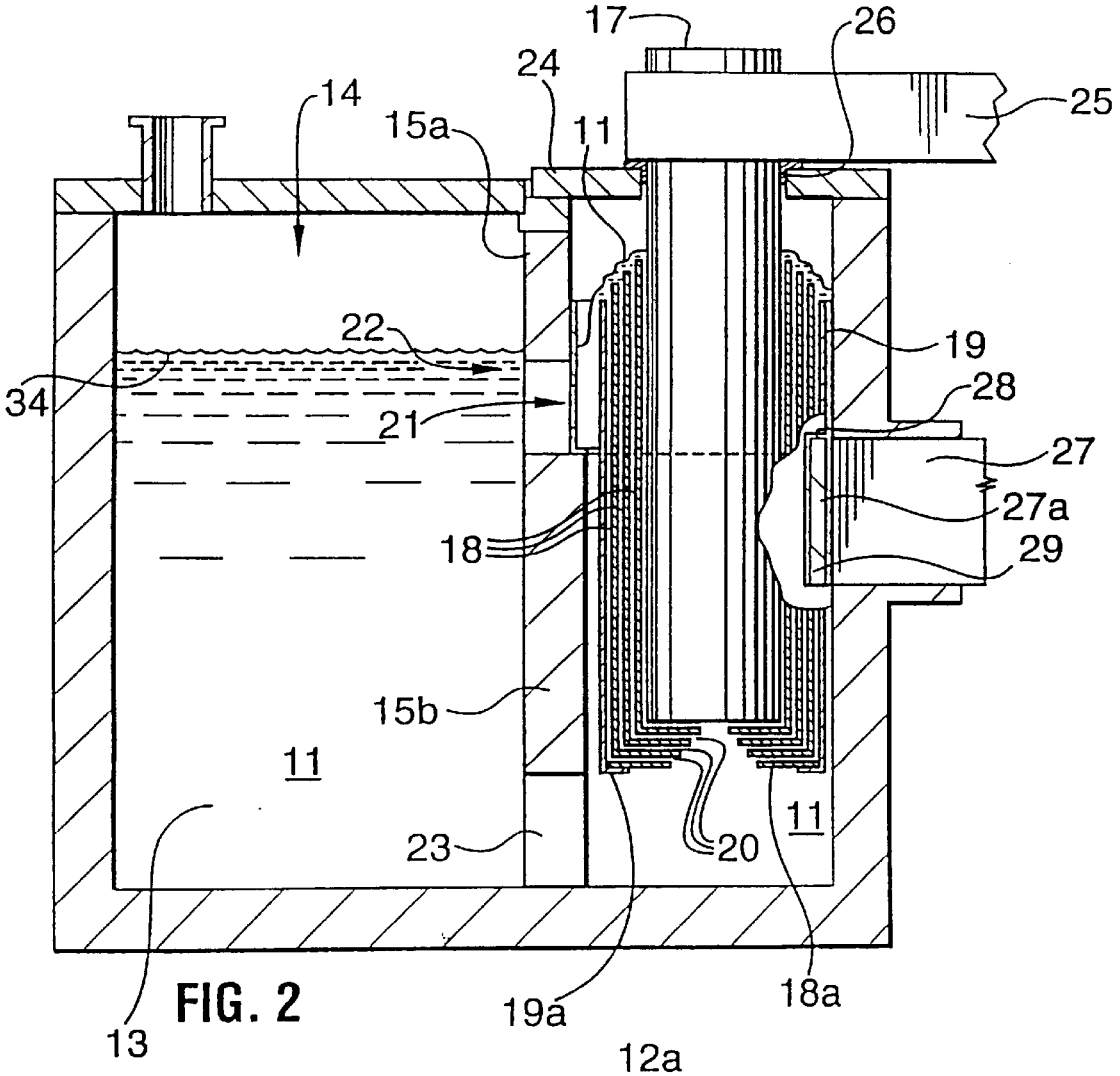
FIG. 2 is a transverse vertical cross-section of the electrolytic cell of FIG. 1, showing in particular the connection of an electrode assembly to a busbar of the cell.
Figure 3:
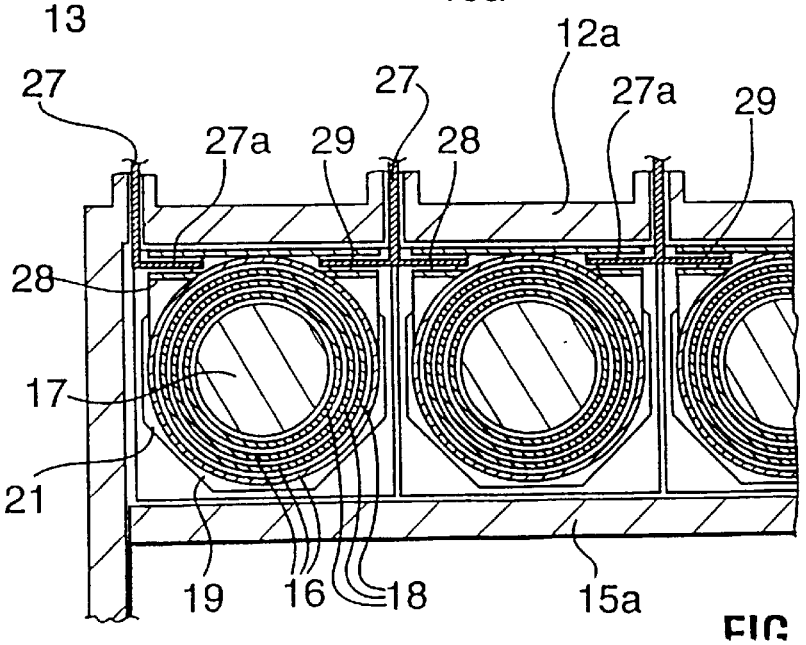
FIG. 3 is a horizontal cross-section of an upper part of the electrolysis compartment of the cell of FIG. 1, showing the concentric geometry of electrode assemblies composed of cylindrical anodes, annular bipolar electrodes, annular cathodes, cathode compartment baffle plates and their connecting parts.

FIGS. 1, 2 and 3 illustrate a first embodiment of a cell 10 of the present invention which consists of a housing 12, formed by cell walls 12*a* and a cell floor 12*b*, and contains at least one electrolysis compartment 13 and at least one additional compartment 14 (see FIG. 2) referred to as a metal-collecting compartment. During electrolysis, chlorine gas generated by the electrolysis process is collected in (and written from) the upper part of the electrolysis compartment 13, and the product metal, such as magnesium, is accumulated within (and eventually withdrawn from) the additional compartment 14. A curtain wall 15*a*, 15*b* constructed of refractory brick is provided. The upper portion 15*a* separates the atmospheres of these two compartments. The lower portion 15*b* separates the electrolyte in the two compartments, although openings 22, 23 are provided to permit recirculation of electrolyte, as will be described later.

The electrolysis takes place within interpolar spaces 16 formed between principal electrolysing surfaces of a graphite anode 17, one or more bipolar electrodes 18 and a metal (usually steel) cathode 19. Although three bipolar electrodes 18 are illustrated in this embodiment, the number may vary, but there is always at least one. The anode 17, bipolar electrodes 18 and cathode 19 are illustrated as having vertical cylindrical principal electrolysing surfaces, but they may reduce slightly and uniformly in diameter towards the bottom of the cell, thus forming tapered anode assemblies.

The bipolar electrodes 18 and the cathode 19 have inwardly directed extensions 18*a* and 19*a*, respectively, at their lowermost ends and these extensions project under the lower end of the anode 17. These extensions are continuous with the electrodes and are connected mechanically and electrically to their respective electrodes. The inward extensions 18*a* and 19*a* are substantially horizontal.

The cell illustrated in FIG. 1 has four separate cassette and anode assemblies. It is, however, within the scope of the present invention to include more or fewer such electrode arrangement in a single electrolysis compartment and, of course, to provide several such electrolysis compartments in a single cell.

In an electrolysis process using the electrolytic cell of the present invention, a metal compound (such as magnesium chloride), dissolved in an electrolyte (such as sodium chloride and calcium chloride), is decomposed by a direct current passing between the anode and the cathode via the bipolar electrodes. The products of the electrolysis are chlorine gas and molten magnesium (when magnesium chloride is the metal compound).

The chloride gas tends to rise to the surface of the molten electrolyte in the interpolar spaces 16 which communicate with the bulk of the electrolyte through entrance slots 20 formed between the horizontal electrode extensions 18*a* and 19*a*. The upward movement of the gas creates a pumping action which forces electrolyte up through the interpolar spaces 16, entraining the chlorine gas and small magnesium droplets generated therein. The entrance slots 20 are of different diameters, with the largest being in the cathode 19 and the smallest in the bipolar electrode adjacent to the anode 17. This contributes to greater uniformity of electrolyte flow through the gaps between the electrodes, but also increases the current path for leakage currents and thereby reduces them. A larger gap between the extensions 18*a* and 19*a,* than between the electrode 18 and 19, also contributes to flow uniformity and reduces bypass currents.

The molten mixture 11 exist the interpolar spaces 16 at the top of the cassette, where the chlorine escapes through the upper part of the electrolysis compartment 13 and the molten electrolyte entraining small magnesium droplets runs off into channels 21, incorporated into the external structure of the cathode 19. The liquid then finally discharges through a passage 22 in the curtain wall 15*a,* 15*b* into the additional metal-collecting compartment 14, where the small magnesium droplets rise to the surface and the electrolyte descends to return to the entrance of the electrolysis chamber through a passage 23 in the lower part of the curtain wall 15*b*.

The anodes 17 project above a cell cover 24 and are electrically connected to clamps 25, which are water-cooled to maintain a good electrical contact between the anodes and the clamps, and which form connections for the supply of electrolysis current. The clamps are also used to support the anodes 17 by resting on the cell cover, and the anodes, supported in this way, are kept spaced apart from the extensions 18*a* of the bipolar electrodes at their lower ends. Additionally, insulating refractory separators (not shown) may be used to maintain the positions of the anodes centrally within the innermost bipolar electrodes 18. The cell is also provide with seals 26 between the cell cover 24 and the anode 17 to prevent ingress of air which would otherwise occur since the electrolysis compartment 13 is normally operated at slightly below atmospheric pressure in order to withdraw the chlorine product.

The cathode 19 makes electrical connection with a cathode busbar 27 via an inverted channel member or hook 28 which fits over an extension 27*a* of the cathode busbar 27. The extension 27*a* is at right angles to the cathode busbar 27 and together they form either an L-section or a T-section depending on the location within the cell. During assembly of the cell, the self-supporting cassette formed by the cathode 19 and the bipolar electrodes and extensions is installed by lowering the hook 28 over the busbar extension 27*a.* An inner flat surface 29 of the hook 28, connected electrically top the cathode, then makes a low resistance electrical contact with the cathode busbar extension. No welds or fastenings are required for this connection, and therefore the entire cassette can be removed after use. In addition, the lack of welds means that thermal expansion can be accommodated during cell heat-up. In the illustrated embodiment, the hook 28 provides the entire support for and positioning of the cassette within the electrolysis compartment, since the lower end of the cassette is clear of the inner refractory lined bottom wall of the cell.

Figure 4:
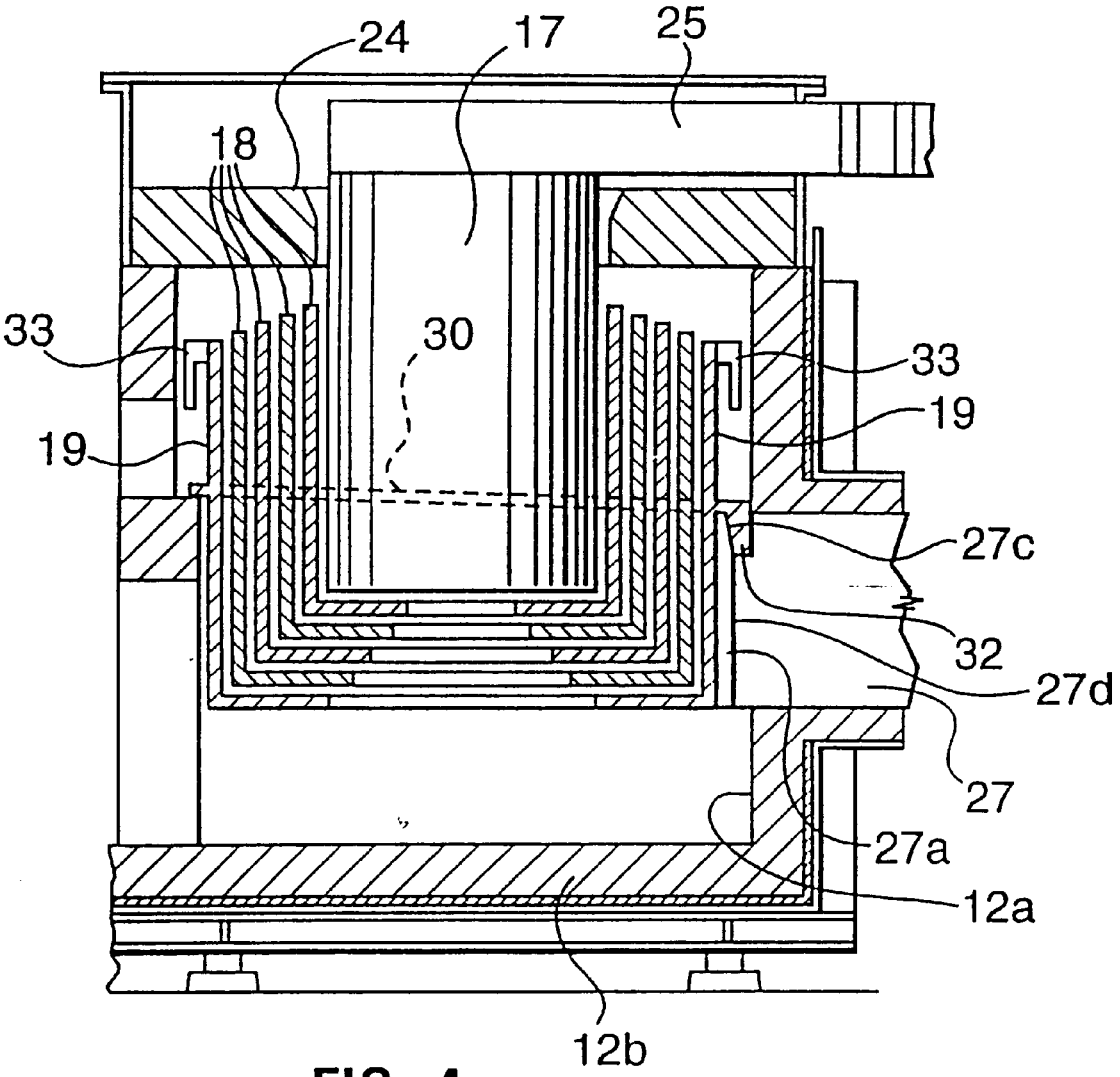
FIG. 4 is a transverse vertical cross-section of an electrolytic cell similar to that of FIG. 1 showing an alternative connection to a busbar of the cell, and a lifting arrangement for installing or removing the assembly.
Figure 5:
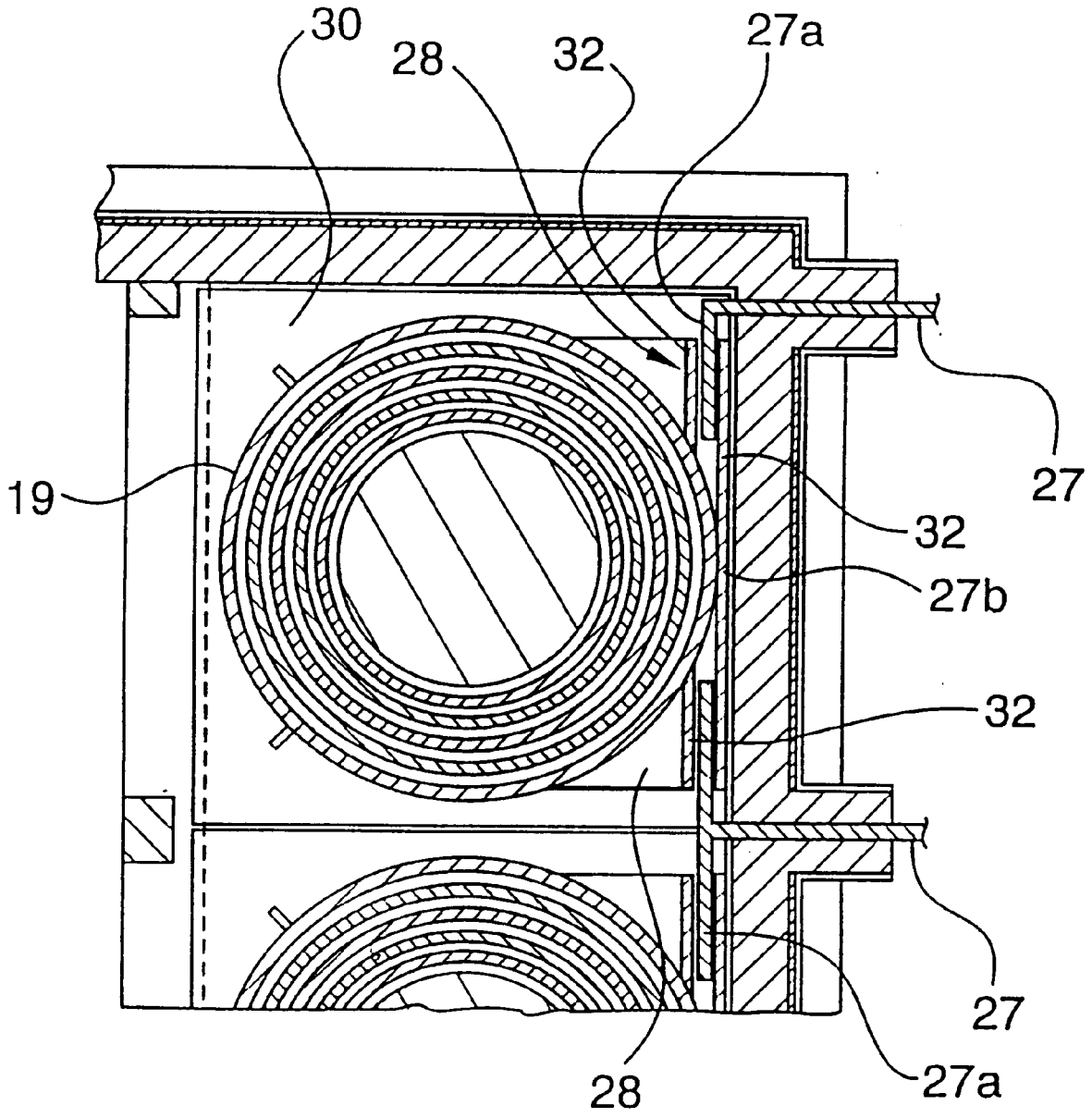
FIG. 5 is a partial horizontal cross-sectional view of the cell of FIG. 4.

Another version of the electrolysis compartment is shown in FIGS. 4 and 5. This is a modification of the cylindrical electrode arrangement shown in FIG. 2. The arrangement of cathode 19 and four bi-polar electrodes 18 is essentially the same as that in FIG. 2. A plate 30 is provided which is horizontal or slightly sloping around the outer periphery of the cathode 19. The plate is in the form of a square or rectangle which forms a roughly horizontal partition within the electrolysis chamber and serves to prevent electrolyte containing magnesium droplets, which has flowed from the top of the electrode assembly, from returning directly to the bottom of the electrolysis compartment 13. This arrangement serves the same function as the channels 21 in FIG. 2. A cathode busbar 27, in the form of a conductor of rectangular cross-section, enters through the cell wall 12*a.* The busbar is terminated in a T-section or an L-section 27*b.*

The upper corner 27*c* of the Tee or L-section is slightly bevelled, as shown. Downwardly projecting plates 31 are attached to the plate 30 at right angles and, when the assembly is installed in the cell, make contact with the inside face 27*d* of the T- or L-section. Additional downwardly projecting plates 32 are attached to the plate 30 and are bevelled to match the bevel 27*c* on the busbars. On installation in the cell, the weight of the electrode assembly is borne by the busbar(s) 27, 27*b,* via the hook 28 formed by member 31 and 32 and a portion of the plate 30. The plate 30 may be in close proximity to the cell walls, but is not supported by them. To simplify installation and removal of the electrode assembly, hooks 33 are provided on the outer periphery of the cathode 19. A lifting arrangement (e.g. a hoist—not shown) engages these hooks to lift the entire electrode assembly.

Figure 6:
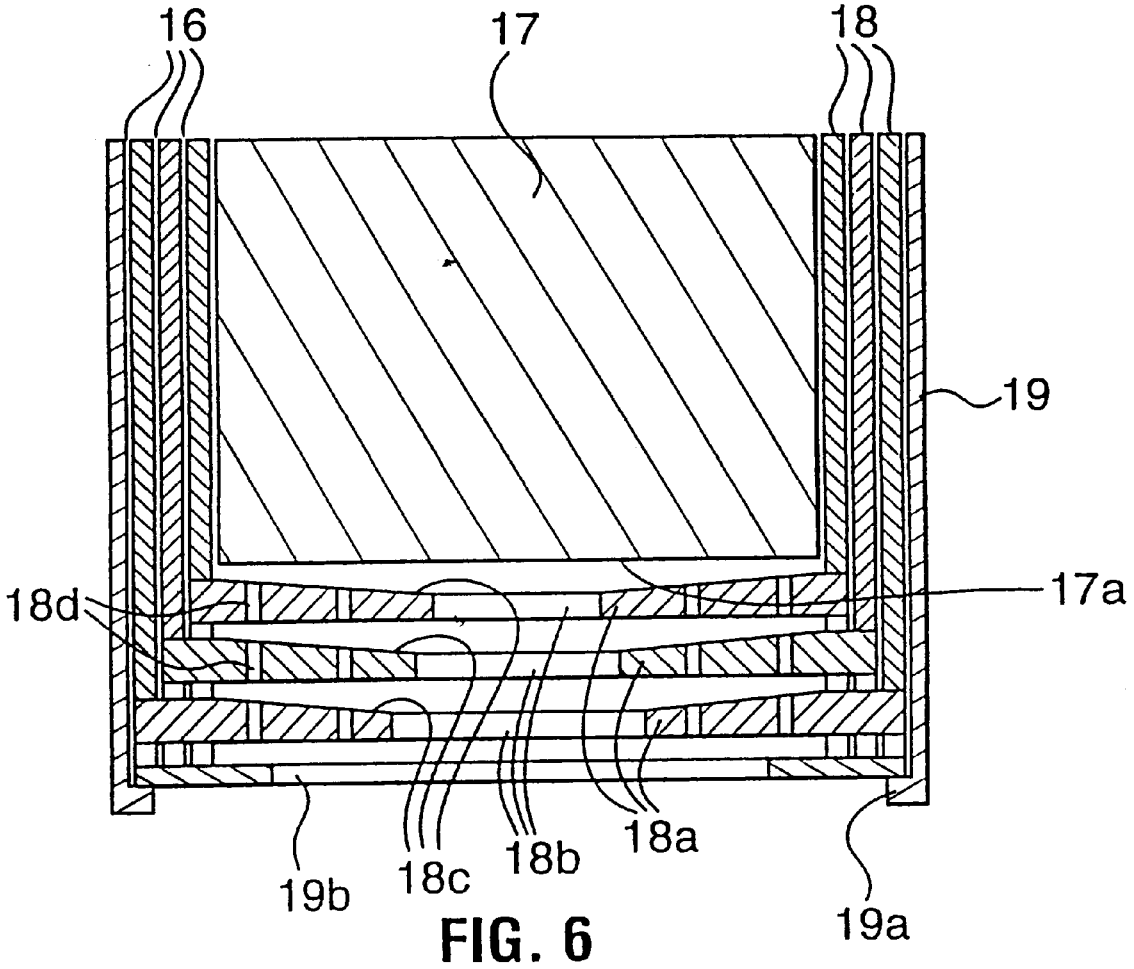
FIG. 6 is a partial vertical cross-sectional view of a modified electrode assembly according to the invention, particularly showing horizontal extensions of the bipolar electrodes and cathode and entrance slots for electrolyte flow.

FIG. 6 is an enlarged partial cross-section of an electrode arrangement similar to that of FIGS. 1 to 5 but showing a slight variation. In this embodiment, the gaps between the horizontal extensions 18*a* and 19*a* of the bipolar electrodes 18 and cathode 19, and similar gaps between the innermost bipolar electrode and the undersurface 17*a* of the anode 17, and the openings 18*b* and 19*b* at the centres of the extensions 18*a* and 19*a* are preferably sized so that the cross-sectional area for electrolyte flow to the interpolar spaces 16 promotes uniform electrolyte velocities throughout the main parts of the electrode assembly. The horizontal extensions 18*a* of the bipolar electrodes 18 preferably have upper surfaces 18*c* that slope slightly downwardly towards the centre, as shown, and preferably have small penetrating holes 18*d* to prevent the accumulation of sludge (principally MgO) which would otherwise block electrolyte flow and possibly cause shorting.

In the operation of electrolytic cells of this invention, it is important to keep the electrolyte depth on the top of the electrodes (e.g. as shown at 11 in FIG. 2) as small as possible to prevent bypass-currents whilst still ensuring that the chlorine/magnesium separation occurs efficiently. It may be necessary to provide level control for the electrolyte in the electrolysis compartment to achieve this. Suitable methods and apparatus are described in U.S. Pat. No. 4,518,475 to O. Sivilotti, the disclosure of which is incorporated herein by reference.

Figure 7:
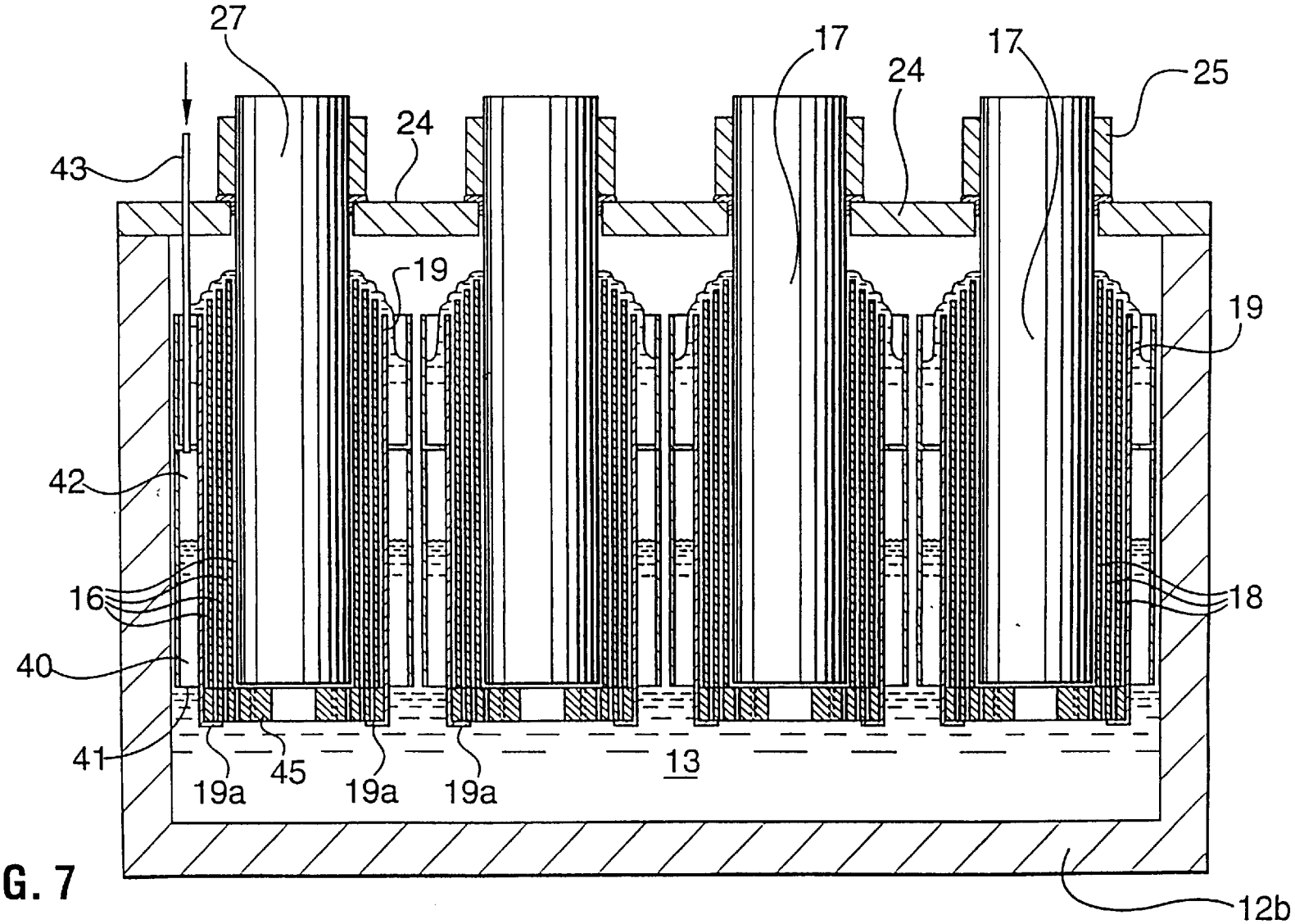
FIGS. 7 and 8 are, respectively, a longitudinal vertical cross-section and a transverse vertical cross-section of another preferred embodiment of the cell of the invention incorporating a level control device within the electrode assemblies and a refractory grid to support the bipolar electrodes.
Figure 8:
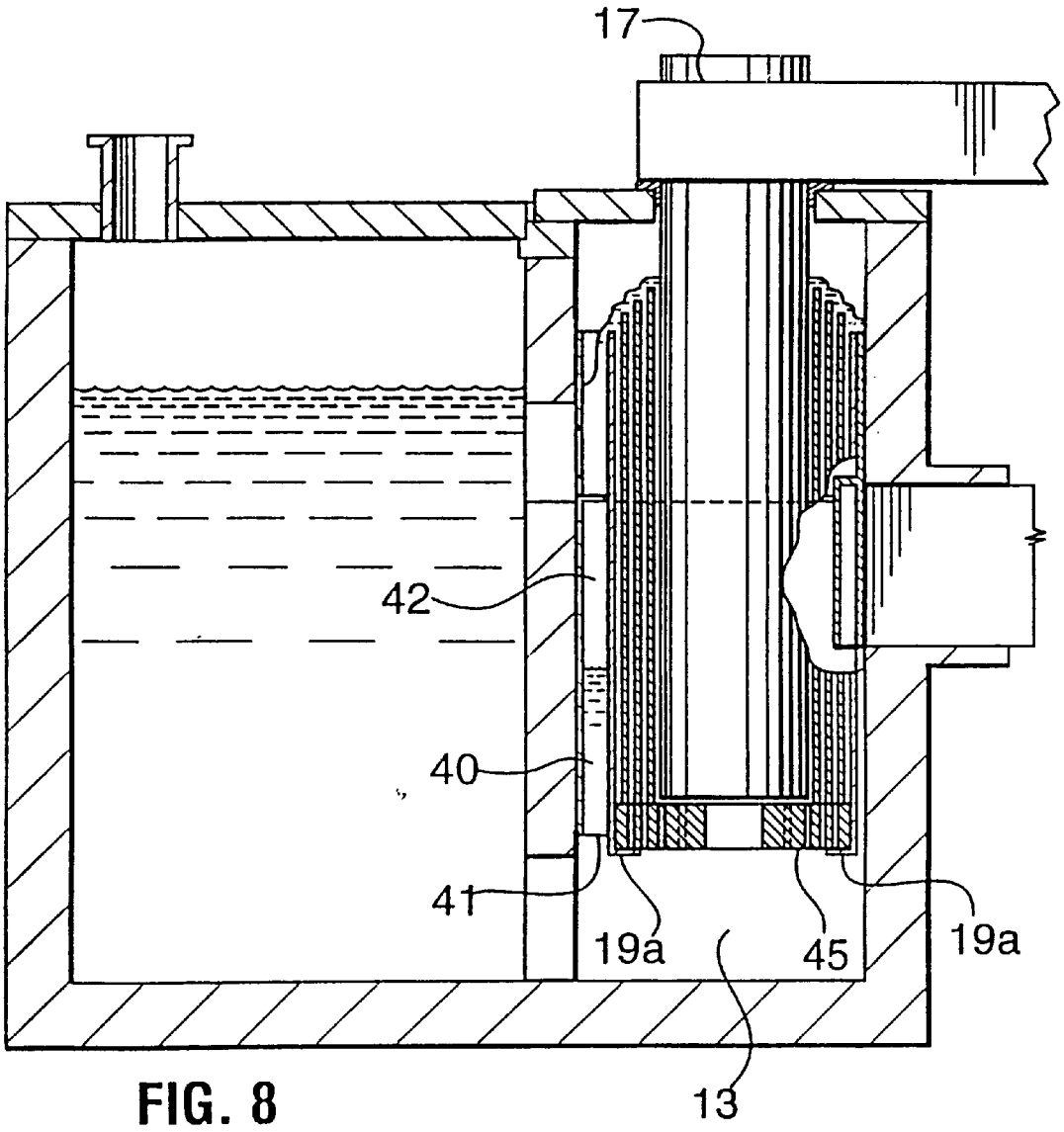

FIGS. 7 and 8 show an alternate level control system that may be used in the present invention. A reservoir is incorporated into the cathode 19 of the general type already described by means of a compartment 40. An opening 41 is provided in the bottom of the compartment to permit electrolyte to enter and leave the compartment, and an inert gas (such as argon) may be introduced into the upper portion 42 of the compartment. By introducing the inert gas through a pipe 43 under pressure or by venting the gas through the pipe, the electrolyte level can be controlled since more or less electrolyte will be displaced by the argon gas from the reservoir 40 into the electrolysis compartment 13. While this reservoir arrangement is particularly suited for use with electrode assemblies of the type described herein, the incorporation of such reservoirs into cathodes used in conventional cells would also be extremely useful as an alternative to more bulky and complex arrangements of the conventional kind.

It will be noted in FIGS. 7 and 8 that the bipolar electrodes 18 do not have inward extensions, as in the previous embodiments. In this case, support for the bipolar electrodes is provided by an electrically insulated refractory grid 45 that has suitable holes or perforations to permit molten electrolyte to flow into the interpolar spaces 16. The cathode is provided with horizontal extensions 19*a* (as before) to support and retain the refractory grid. In this way, the assembly still forms a self-contained cassette and can be inserted and removed from the cell as a unit, as before. Because the ends of the cathode and the bipolar electrodes rest on the insulating grid, the bath leakage currents must pass through the refractory plate and intervening electrolyte, making the path longer and the leakage currents therefore lower.

Figure 9:
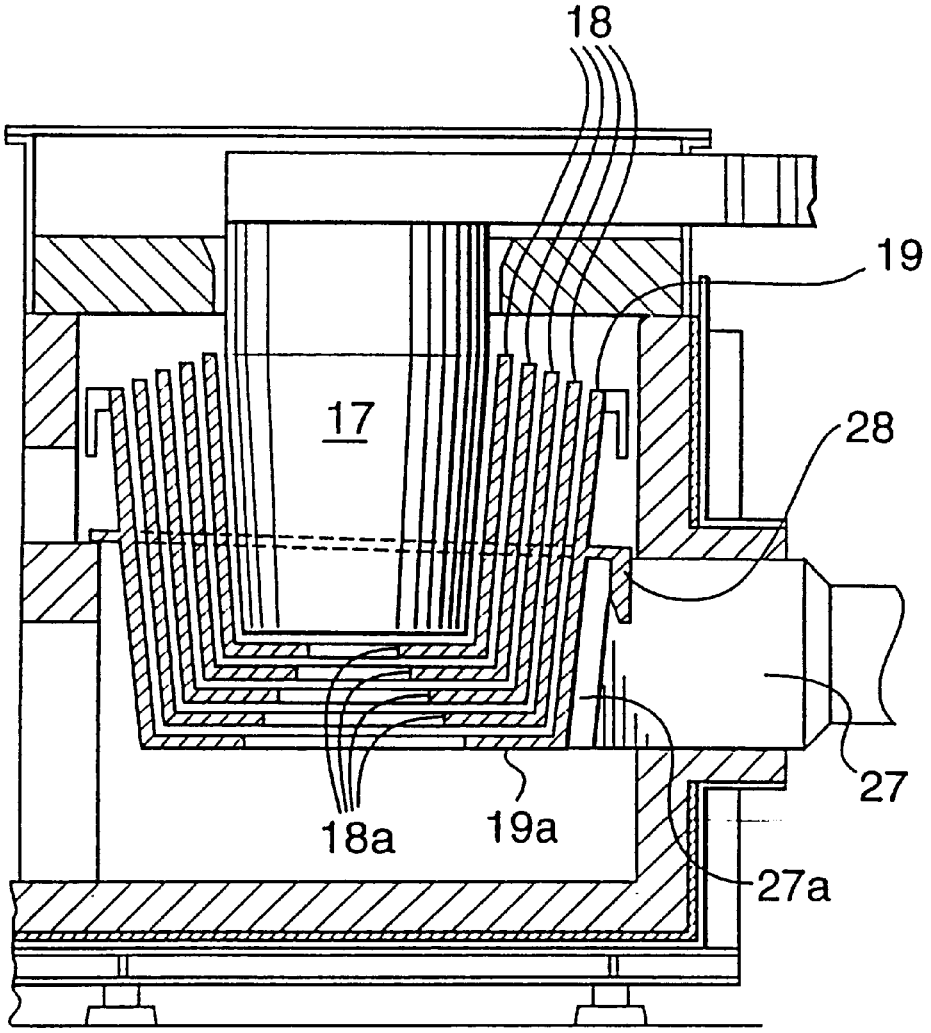
FIG. 9 is a transverse vertical cross-section of yet another cell according to the invention showing an electrode assembly in which the cathode and the bipolar electrodes are tapered for easier assembly and installation.

A variation of the designs of FIGS. 1 to 5 is shown in FIG. 9. In this embodiment, the anode 17 bipolar electrodes 18 and cathode 19 are cylindrical but tapered. The taper is the same for all the electrodes to ensure uniformity of inter-electrode spacing. The cathode busbar 27 is provided, as in the other designs with an extension 27*a* at right angles, except that in this embodiment the extension 27*a* is sloped at the same angle as the taper of the cathode 19 so that when the cassette is installed in the cell, and held in place by the hook 28, there is good electrical contact between the cathode busbar and the cathode. The hook 28 is bevelled to permit the assembly, with sloping or tapered surfaces, to be installed and removed easily from the cell.

Figure 10:
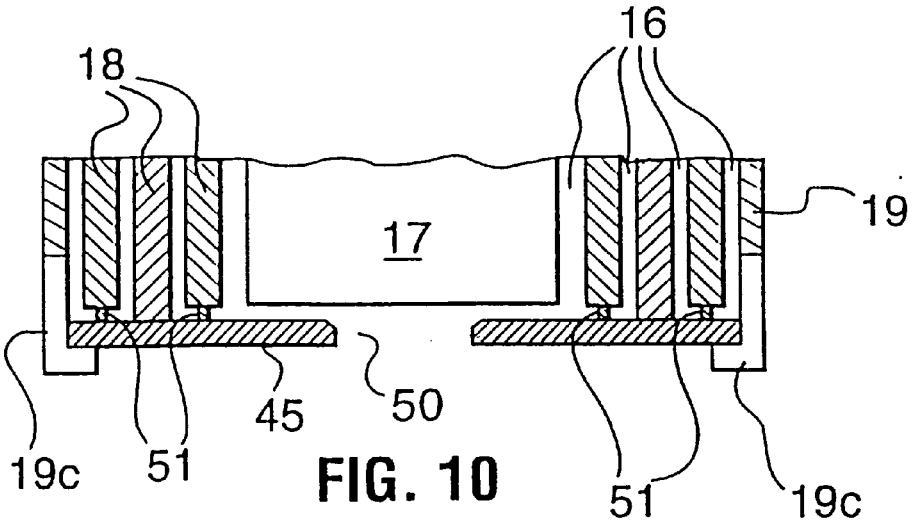
FIG. 10 is a transverse vertical cross-section of yet another electrode assembly in which a refractory plate with a single central hole is used to support the bipolar electrodes, and the electrodes are spaced at various distances from the plate to permit electrolyte flow both through the central hold and through the annular space below the cathode or below the outer bipolar electrode.

A further variation on the design of FIGS. 7 and 8 is shown in FIG. 10. The lower end of an electrode assembly consisting of an anode 17, three bipolar electrodes 18 and a cathode 19 is shown. A refractory plate 45 with a hole 50 in the centre, concentric with the anode and other electrodes, is provided. The refractory plate 45 is supported by L-shaped lugs 19*c* extending downwardly and inwardly at several locations around the periphery of the lower end of the cathode, but leaving most of the peripheral areas of the lower end of the unobstructed. Electrolyte can therefore flow into the electrode assembly via the unobstructed areas around the lower end of the cathode and through hole 50 and up through all of the interpolar spaces 16. The innermost and outermost bipolar electrodes are maintained at a distance from the plate 45 by means of small spacers 51 or local extensions of the electrodes that permit almost unobstructed electrolyte flow under the lower ends of corresponding electrodes. The central bipolar electrode is supported directly on the plate 45. Anode 17 is held by its external support (not shown) at a distance from the plate 45 at a greater distance than the innermost bipolar electrode. Similarly the continuous peripheral portion of the lower end of the cathode terminates higher than the bottom end of the outermost bipolar electrode. This effectively reduces the bypass ;currents at the bottom of the assembly by maximizing the bypass distance (path through the electrolyte between non-nearest neighbour electrodes). The resulting simple refractory design is inexpensive.

In fact, the entire apparatus of the present invention can be manufactured relatively simply and inexpensively. For example, the graphite bipolar electrodes 18 may be formed from individually machined, suitably shaped pieces that are mechanically fastened together using screws, pins, dowels or similar fastenings to form single mechanical and electrical electrode components. Lap, threaded or dovetail joints may also be used. The graphite pieces may alternatively be joined by gluing using a cement or adhesive, e.g. by a procedure as disclosed in U.S. Pat. No. 4,816,511 mentioned earlier. The horizontal electrode extensions, when required, may be fixed in similar ways to the lower ends of the vertical sections of the electrodes.

As already noted above, the bipolar electrodes (and the surrounding cathode) can have any convenient shape in horizontal cross-section. However, a cylindrical or annular shape is preferred. For such shapes, the graphite bipolar rings and the anode can be fabricated from a single block of graphite (e.g. on a vertical boring mill where the work-piece rotates and the machining tool consists of a bit and a shank having a thickness slightly smaller than the material to be removed, which is typically the required inter-polar distance). The graphite bipolar electrodes may be made from one or more vertical sections of the same diameter, preferably machined as above along with other bipolar electrodes from a single block of graphite, which may be glued or mechanically fastened together, for example by means of threaded joints, as described above. Using this method, it is possible to assemble bipolar electrodes having a height of 2 meters or more and interpolar separations in the order of 5 to 7 mm, which is the kerf removed by the milling operation.

As mentioned above, the electrode assemblies of this invention are preferably constructed as cassettes. Because of the design of this invention, the cassette may be assembled outside the cell and then inserted into the cell as a single complete unit. A metal cathode shell (completely enclosing the structure) may be used, and the horizontal extensions (or insulating refractory grid) and the bipolar electrodes may then be successively inserted into the cathode shell, using insulating refractory spacers where necessary. If a cathode shell that is continuous is used, it is even possible to form the bipolar electrodes from pieces that are not held or bonded together in the form of unitary structures, i.e. that are not mechanically and electrically single entities, and during assembly to provide insulating refractory spacers at appropriate positions for support of the electrode pieces. This still permits the assembly to be installed in the cell as a single entity. However, for maximum strength of the assembly, and for long term electrical integrity, bipolar electrodes that are single unitary structures (whether cut from a single piece or mechanically joined or glued to form a single structure) are preferred. The cassette is fully assembled and can be installed in the cell, and retains its integrity during extended operations and may be removed as a single unit from the cell. The anode is separately installed and removed.

EXAMPLE

A full-sized cell having a design as shown in FIGS. 1, 2 and 3 was built and operated for 600 days. The cell performed as expected, having a cell voltage of 13.5 to 14.2 volts and a current efficiency of between 75 and 80%. This current efficiency is 5 to 10% higher than a cell of conventional design which did not use an electrode assembly of the cassette type.

We claim:

1. An electrolytic cell for recovery of a metal from a molten electrolyte containing a metal compound, said cell having a housing containing at least one internal electrolysis compartment, at least one electrode assembly in each said compartment, said assembly including an anode, a cathode and at least one bipolar electrode disposed between said anode and said cathode so as to form interpolar spaces in which electrolysis occurs, and connections for conveying electrical current to and from said cell, wherein said bipolar electrode, or each said bipolar electrode when there is more than one, mechanically and electrically comprises a single entity and substantially completely surrounds the principal electrolysing surface of said anode, or a next-innermost bipolar electrode, and wherein said cathode substantially completely surrounds the principal electrolysing surface of said bipolar electrode or, when there is more than one of said bipolar electrodes, an outermost one of said bipolar electrodes.

2. An electrolytic cell according to claim 1 wherein said cathode mechanically and electrically comprises a single entity.

3. An electrolytic cell according to claim 1 wherein said cathode and said at least one bipolar electrode are held together in the form of a unitary assembly that can be inserted into said electrolysis compartment as a single unit.

4. An electrolytic cell according to claim 3 wherein said unitary assembly can also be withdrawn from said electrolysis compartment as a single unit.

5. An electrolytic cell according to claim 3 having at least one connector on said cathode for attachment to a cathode busbar, said connector providing support for said unitary assembly on said busbar.

6. An electrolytic cell according to claim 1 wherein said cathode has an open lower end and carries an inwardly extending support structure at said lower end, said support structure providing support for said at least one bipolar electrode, at least during assembly of said cell.

7. An electrolytic cell according to claim 6 wherein said support structure comprises an extension of said cathode projecting partially over said open lower end, said at least one bipolar electrode being supported, at least during assembly of said cell, on said extension via at least one electrically insulating spacer.

8. An electrolytic cell according to claim 7 comprising a plurality of bipolar electrodes, each having open lower ends provided with extensions projecting inwardly partially over said open lower ends, each said extension except for said extension of an innermost bipolar electrode, providing support, at least during assembly of said cell, via at least one insulating spacer, for a next innermost bipolar electrode.

9. An electrolytic cell according to claim 6 wherein said support structure is an insulated structure through which electrolyte can enter said interpolar spaces, said support structure being carried by supports from said cathode.

10. An electrolytic cell according to claim 9 wherein said insulated support structure is in the form of a perforated plate.

11. An electrolytic cell according to claim 1 wherein said at least one bipolar electrode has a horizontal cross-sectional profile defined between opposed anode- and cathode-facing electrolysing surfaces that are each circular, elliptical, square, rectangular, polygonal or oval.

12. An electrolytic cell according to claim 11 wherein said at least one electrode has a horizontal cross-sectional profile defined between opposed anode- and cathode-facing electrolysing surfaces that are each circular.

13. An electrolytic cell according to claim 12 wherein said cathode has a horizontal cross-sectional shape that is a circular annulus.

14. An electrolytic cell according to claim 11 wherein said cathode has a horizontal cross-sectional shape that is the same as said shape of said at least one bipolar electrode.

15. An electrolytic cell according to claim 1 wherein said at least one bipolar electrode is machined from a single piece of graphite.

16. An electrolytic cell according to claim 1, wherein said at least one bipolar electrode comprises a plurality of pieces of graphite fastened together by fastening means selected from the group consisting of glue and mechanical fasteners.

17. An electrolytic cell according to claim 16 wherein each bipolar electrode of said plurality is made up of at least two annular sections of corresponding diameter stacked vertically, wherein said annular sections of corresponding diameter are fastened together by fastening means selected from the group consisting of glue and mechanical fasteners to form a single electrical and mechanical entity, and wherein each said annular section is a single piece of graphite.

18. An electrolytic cell according to claim 16 having a plurality of bipolar electrodes, said plurality of bipolar electrodes comprising at least two vertically stacked nested groups of annular sections wherein individual annular sections of corresponding diameter of adjacent groups are fastened together by fastening means, and wherein said nested groups of annular sections are each a product formed from a single piece of graphite by a milling operation involving removal of a kerf to form said interpolar spaces.

19. An electrolytic cell according to claim 1, having a plurality of said bipolar electrodes forming a nested group, wherein said nested group of bipolar electrodes is a product formed from a single piece of graphite by a milling operation involving removal of a kerf to form said interpolar spaces.

20. An electrolytic cell according to claim 1, wherein said at least one bipolar electrode is made of graphite having a steel liner on an anode-facing surface thereof, said steel liner being attached to the graphite by gluing or mechanically fastening.

21. An electrolytic cell according to claim 1, wherein an electrolyte level control mechanism is incorporated within said cathode.

22. An electrolytic cell for recovery of a metal from a molten electrolyte containing a metal compound, said cell having a housing containing at least one internal electrolysis compartment, at least one electrode assembly in each said compartment, said assembly comprising an anode, a cathode and at least one bipolar electrode disposed between said anode and said cathode so as to form interpolar spaces in which electrolysis occurs, and connections for conveying electrical current to and from said cell, wherein said cathode substantially surrounds the at least one bipolar electrode and said anode, and wherein said cathode and said at least one bipolar electrode are held together in the form of a unitary assembly that is adapted for insertion into the electrolysis compartment as a unit during cell assembly.

23. A unitary electrode assembly for insertion into an electrolytic cell used for recovery of a metal from a molten electrolyte containing a metal compound, including at least one bipolar electrode and a cathode, wherein each said bipolar electrode comprises mechanically and electrically a single entity, and in that said cathode substantially surrounds a principal electrolysing surface of said bipolar electrode(s) and holds said bipolar electrode(s) as a single unit.

24. An assembly according to claim 23 wherein said cathode mechanically and electrically comprises a single entity.

25. An electrolytic cell for recovery of a metal from a molten electrolyte containing a metal compound, said cell having a housing containing at least one internal electrolysis compartment, at least one electrode assembly in each said compartment, said assembly comprising an anode and a cathode, and connections for conveying electrical current to and from said cell, wherein said cathode has a structure that incorporates an electrolyte level control mechanism.

* * * * *